US006478201B2

(12) United States Patent
Takahashi et al.

(10) Patent No.: US 6,478,201 B2
(45) Date of Patent: Nov. 12, 2002

(54) STOPPER FOR CONTINUOUS CASTING

(75) Inventors: Shigeaki Takahashi, Gifu (JP); Noriyoshi Naruse, Gifu (JP); Andy Elksnitis, Ontario (CA)

(73) Assignee: Akechi Ceramics Kabushiki Kaisha (JP)

( * ) Notice: Subject to any disclaimer, the term of this patent is extended or adjusted under 35 U.S.C. 154(b) by 14 days.

(21) Appl. No.: 09/738,698

(22) Filed: Dec. 15, 2000

(65) Prior Publication Data

US 2001/0006177 A1 Jul. 5, 2001

(30) Foreign Application Priority Data

Dec. 28, 1999 (JP) ..... 11-372180

(51) Int. Cl.[7] ..... B22D 41/18
(52) U.S. Cl. ..... 222/602; 222/597; 266/271
(58) Field of Search ..... 222/602, 597; 266/271, 272

(56) References Cited

U.S. PATENT DOCUMENTS 6,026,997 A * 2/2000 Kremer et al. ..... 222/602

FOREIGN PATENT DOCUMENTS

GB 2235889 A * 3/1991 ..... 222/602

* cited by examiner

*Primary Examiner*—Scott Kastler
(74) *Attorney, Agent, or Firm*—Cantor Colburn LLP

(57) ABSTRACT

A stopper for continuous casting comprising a stopper rod and a spindle for actuating the stopper rod, wherein the stopper rod includes a joining nut integrally formed therewith, an upper end surface of the stopper rod being formed so as to be smooth, and a pin hole being provided in the upper end surface so as to prevent from rotating, while the spindle includes a gas introduction route, a male screw provided in a tip portion thereof for being engaged with the joining nut, a male screw provided in an upper portion thereof for being engaged with a fastening nut for fixing the spindle to the stopper rod, and a flange tightly adhered to the upper end surface of the stopper rod and provided with a hole, into which a pin for preventing rotation is inserted. The spindle is fixed to the stopper rod by the joining nut. The flange is fixed to the upper end surface of the stopper rod by the fastening nut so as to be hermetically sealed. The flange and the stopper rod are prevented from being rotated by the pin inserted into the pin hole.

4 Claims, 4 Drawing Sheets

(prior art)

(prior art)

STOPPER FOR CONTINUOUS CASTING

BACKGROUND OF THE INVENTION

1. Field of the Invention

The present invention relates to a stopper for continuous casting used for regulating a flow rate of molten metal which is poured from a tundish into a mold in the continuous casting of metal, e.g., steel, a copper alloy, or an aluminum alloy or the like. In particular, the present invention relates to a tundish stopper for continuous casting which has a high gas sealing capability.

2. Related Art

In the continuous casting, molten metal is received in the tundish which is located above a mold of a continuous casting machine, and then, the molten metal is poured from the tundish through an immersion nozzle into the mold at a flow rate suitable for its casting condition. The tundish stopper for continuous casting regulates the flow rate to control a flow rate of the molten metal into the mold.

FIG. 1 shows a stopper rod 2 used within the tundish. As shown in the drawing, a gas supply route 21 is provided in the stopper rod so as to run through the stopper rod 2 along the center axis thereof, and gas is injected from an injection port 23 formed in the tip portion thereof. The above-mentioned gas comprises, for example, argon gas, which is supplied into an immersion nozzle (not shown) together with the molten metal of at least the fixed flow rate.

If the above-mentioned argon gas is not supplied, the flow of the molten steel generates a negative pressure within an inner bore of the immersion nozzle, and causes the air to enter the inner bore of the nozzle, resulting in oxidation of the molten steel. Consequently, so-called nozzle clogging occurs because of solidification of the molten metal or deposition of a nonmetallic inclusion. The stopper rod 2 includes a joining nut 6 provided in the center axis of its upper portion. A spindle is screwed to be engaged with this nut, thus the spindle is fixed.

FIG. 2 shows the stopper rod 2 having a spindle 4 fitted therein. A tip portion of the spindle 4 is fitted by a screw in the joining nut 6 embedded in the stopper rod 2. A flange 5 is disposed in the upper end portion of the stopper rod to realize firm fixation between the stopper rod 2 and the spindle 4. The flange 5 is fastened to the stopper rod by a fastening nut 12.

To make effective use of a gas introduced through a gas introduction route 40, an arrangement like that described below is proposed so as to prevent an upward leakage of the gas. More specifically, the gas supply route 21 includes a chamfered enlarged taper portion 22 and an enlarged cylindrical portion 24 in the upper side thereof. Corresponding to the above-mentioned features, the spindle includes a chamfered taper portion 42 and a flange portion 44. The enlarged taper portion 22 and the cylindrical portion 24 of the gas supply route are tightly adhered respectively to the taper portion 42 and the flange portion 44 of the spindle so as to secure hermetic sealing.

To secure hermetic sealing, mortar may be applied to a gap between the enlarged taper portion 22 and the cylindrical portion 24 (hereinafter referred to as a "concave portion") of the gas supply route 21 and the taper portion 42 and the flange portion 44 (hereinafter referred to as an "enlarged portion") of the spindle. Thus, a space 26 is provided in the upper end part of the stopper rod, and a space portion 52 is provided in the flange 5 such that superfluous mortar can be released to these spaces.

However, for example when a depth of the molten steel in the tundish reaches 1 m, a static pressure becomes 0.7 atm. A flow velocity of the molten steel at the outlet of the stopper rod is high. In addition, since the stopper rod is made of an alumina graphite refractory, it is impossible to secure complete hermetic sealing, thus a part of atmospheric gas frequently enters the gas supply route 21 from the head portion of the stopper rod. Furthermore, to solve the problem of nozzle clogging caused by an inclusion or the like in the molten metal, the stopper may be moved up and down violently (so-called "flapping"). Such an up-and-down movement of the stopper generates play (in other wards, clearance) in the junction of the stopper rod and the spindle, further damaging the hermetic sealing.

Conventionally, a steel nut has been used as a joining nut formed integrally with the alumina graphite stopper rod. If a casting time is long, however, the carbons in the graphite may infiltrate the steel nut, and a melting point of the steel nut may be lowered, consequently breaking a screw thread. In addition, in the case of the steel nut formed integrally with the stopper rod, since a difference in coefficients of thermal expansion between a refractory material of the stopper and steel of the nut is large, when exposed to a high temperature, cracks occur in the vicinity of the boundary between the stopper and the nut because of the thermal spalling. Thus, play is generated between the stopper rod and the spindle.

As described above, it was impossible to secure hermetically sealed junction between the stopper rod and the spindle by the taper surfaces of both, and to assure smooth casting. In addition, in the case of the stopper having the integrally formed steel nut, for example in the continuous casting of the molten steel, the temperature of the nut reached about 700° C., and play was generated between the nut and the spindle because of thermal expansion. As a result, hermetic sealing was lost between the stopper rod and the spindle. The present invention was made to solve the foregoing problems, and it is an object of the invention to provide a particular casting stopper having a high gas sealing capability.

SUMMARY OF THE INVENTION

In accordance with the present invention, there is provided a first embodiment of a stopper for continuous casting comprising:

a stopper rod including a gas supply route provided in a center portion thereof, and an injection port provided in a tip portion thereof for discharging to an outside a gas passed through the gas supply route; and a spindle for actuating the stopper rod, wherein said stopper rod includes a joining nut integrally formed in a position located at a specified distance from an upper end of the stopper rod and in coaxial relation to an axis of the gas supply route, an upper end surface of the stopper rod being formed so as to be smooth, and a pin hole being provided in the upper end surface so as to prevent from rotating;

said spindle includes a gas introduction route provided in a center portion thereof, a male screw provided in a tip portion thereof for being engaged with the joining nut, a male screw provided in an upper portion thereof for being engaged with a fastening nut for fixing the spindle to the stopper rod, and a flange tightly adhered to the upper end surface of the stopper rod and provided with a hole, into which a pin for preventing rotation is inserted; and said spindle is fixed to the stopper rod by the joining nut, said flange is fixed to the upper end surface of the stopper rod by the fastening nut so as to be hermetically sealed, and said flange and said stopper rod are prevented from being rotated by the pin inserted into the pin hole.

A second embodiment of the invention comprises a stopper for continuous casting, wherein said flange of the spindle is formed integrally with the spindle.

A third embodiment of the invention comprises a stopper for continuous casting, wherein said flange of the spindle is formed by being welded to the spindle.

A forth embodiment of the invention comprises a stopper for continuous casting, wherein said flange of the spindle and said upper end surface of the stopper rod are fixed to each other in a hermetically sealed manner by applying mortar, alternatively holding sealant therebetween.

A fifth embodiment of the invention comprises a stopper for continuous casting, wherein said joining nut is made of structural fine ceramics having a bending strength of at least 100 MPa at a room temperature.

A sixth embodiment of the invention comprises a stopper for continuous casting, wherein said structural fine ceramics comprises any one selected from alumina, mullite, silicon carbide, silicon nitride, sialon and zirconia, or a composite material thereof.

DETAILED DESCRIPTION OF THE PREFERRED EMBODIMENTS

Figure 3:
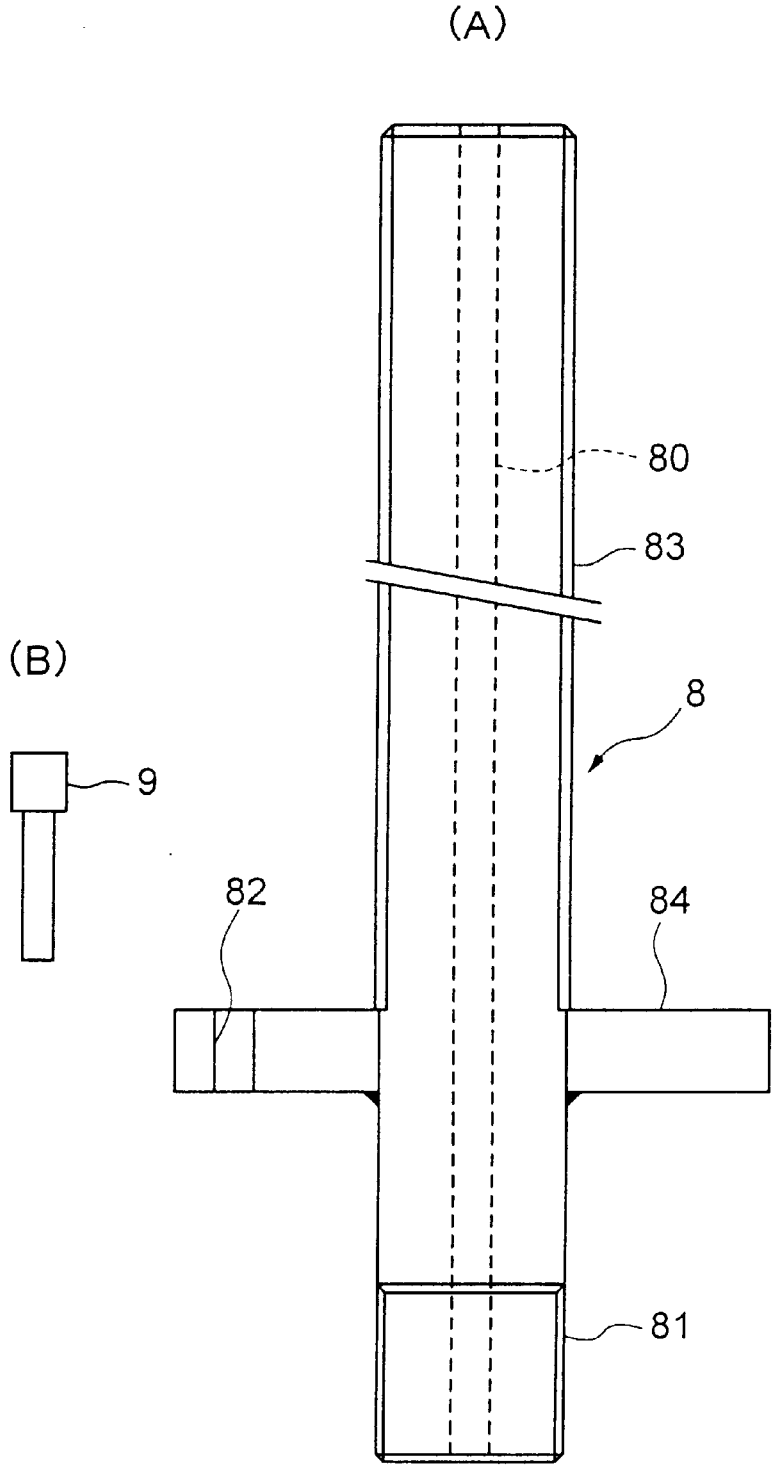
FIG. 3 is a sectional view of a spindle used in the stopper of the present invention for continuous casting.

Now, the preferred embodiment of the present invention will be described with reference to FIGS. 3 and 4. FIG. 3 shows a spindle 8 of the invention. The spindle 8 includes a male screw 81 provided in the tip portion thereof to join with a stopper rod, and a flange 84 integrally formed therewith above the male screw 81 by welding, machining or the like. The flange 84 is brought into contact with the upper end portion of the stopper rod. This flange has one or more holes 82, into which pins 9 are inserted to fix the flange to the stopper rod. The spindle 8 also includes a gas introduction line 80 provided along the longitudinal axis thereof.

Figure 4:
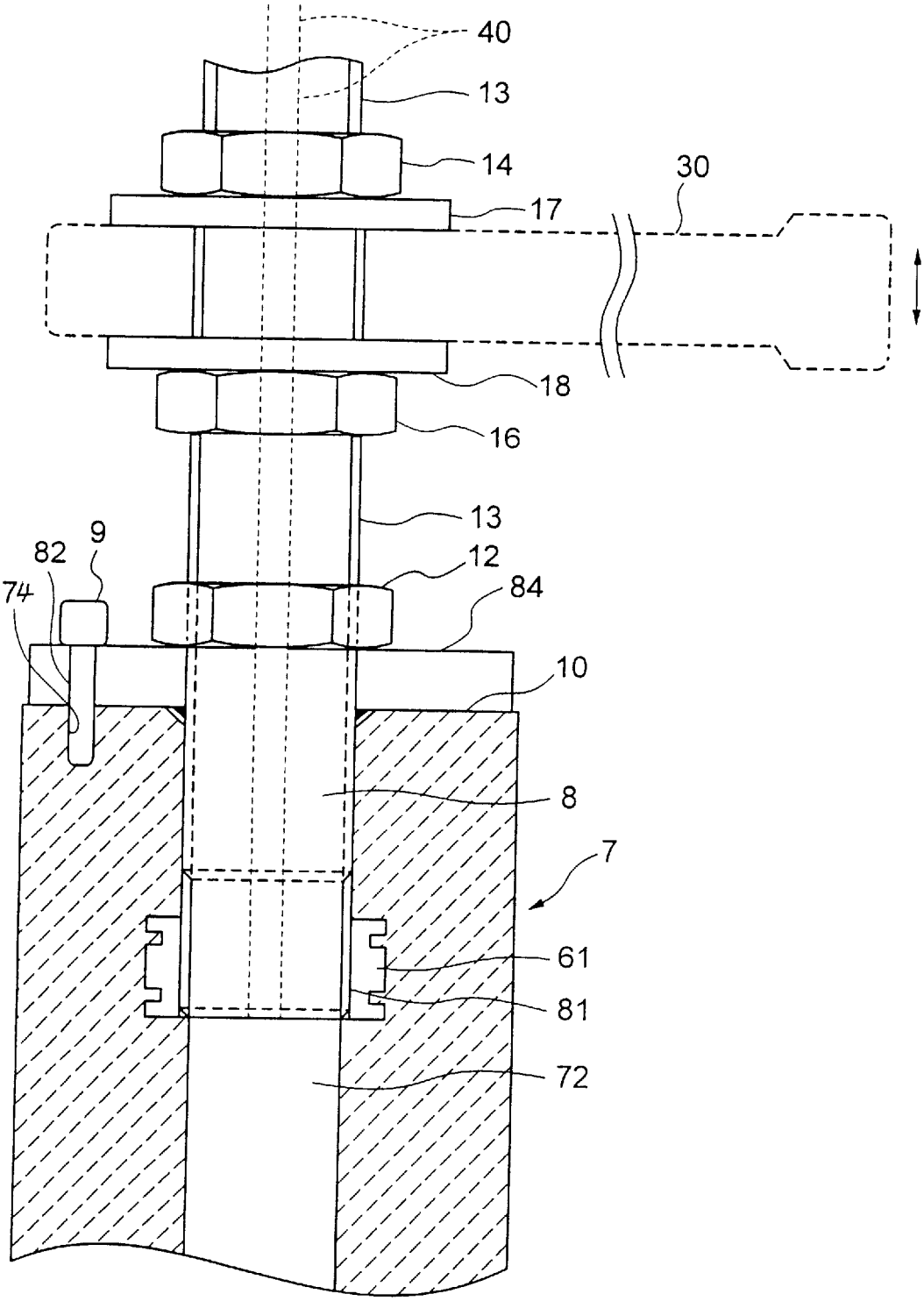
FIG. 4 is a view of the assembled stopper of the invention for continuous casting.

FIG. 4 shows a stopper for continuous casting which is assembled by joining the spindle 8 to a stopper rod 7. The tip portion of the spindle 8 is joined to a joining nut 61 embedded in the stopper rod at the screw portion 81. The joining nut 61 may be made of metal. However, the joining nut 61 is preferably made of structural ceramics (i.e., engineering ceramics) to secure strength of the nut. To prevent breaking, the joining nut is preferably made of structural fine ceramics having a bending strength of at least 100 MPa at a room temperature. The structural fine ceramics preferably comprises one selected from alumina, mullite, silicon carbide, silicon nitride, sialon and zirconia, or a composite material thereof. In addition, the joining nut is preferably embedded in the stopper rod, and integrally formed with the stopper rod.

Figure 1:
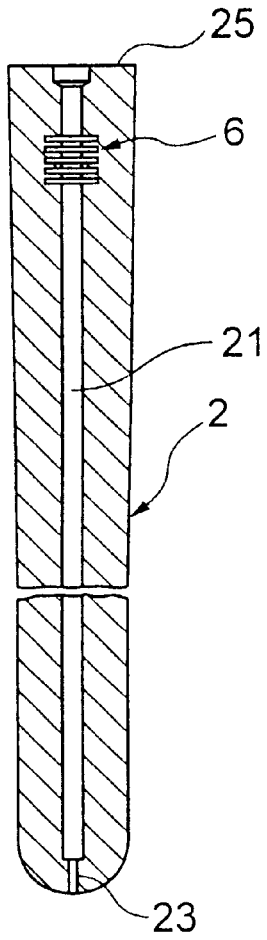
FIG. 1 is a sectional view showing a conventional stopper rod used in a tundish for continuous casting.
Figure 2:
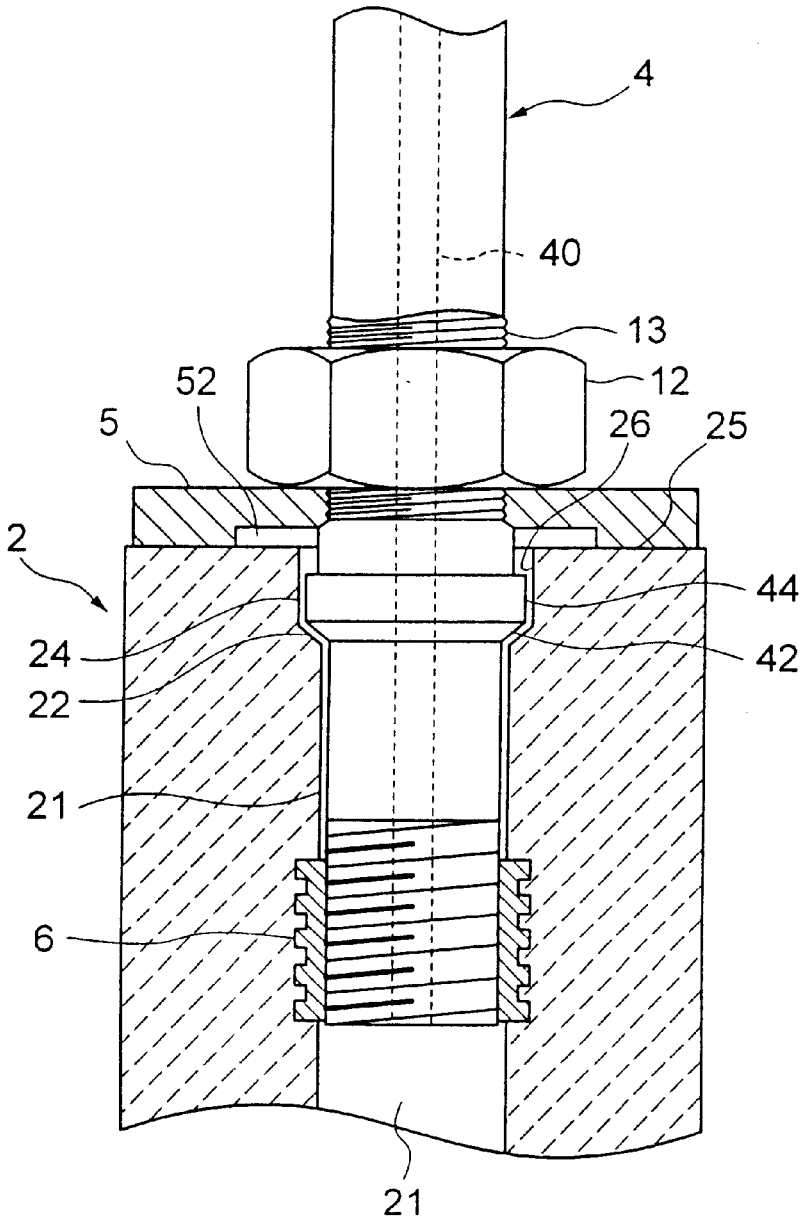
FIG. 2 is a view showing a conventional example of junction between the stopper rod and a spindle.

The assembled stopper of the invention for continuous casting comprises: the stopper rod 7 including a gas supply route 72 formed along the longitudinal axis thereof, and an injection port 23 (the same injection port as shown in FIG. 1) provided in the tip portion of the stopper rod to discharge to the outside the gas which passes through the gas supply route; and the spindle 8 for actuating the stopper rod.

In the stopper rod 7, the joining nut 61 is integrally formed by a cold isostatic pressurization (CIP) method in a position located a specified distance lower from the upper end of the stopper rod, and the axis of the joining nut is in coaxial relation to a gas supply route. The upper end surface 10 is preferably chamfered to be smooth, and a pin hole 74 is provided in this upper end surface portion to prevent rotation. The above-mentioned spindle 8 includes a gas introduction route 40 provided along the center portion thereof, the male screw 81 provided in its tip portion for being engaged with the joining nut 61, and a male screw 13 provided in the upper portion of the spindle for being engaged with a fastening nut 12 so as to fix the spindle to the stopper rod.

The flange 84 is tightly adhered to the upper end surface 10 of the stopper rod 7, and is provided with a hole 82 penetrated by the pin 9 inserted into the pin hole 74 for preventing the rotation. The spindle 8 is fixed to the stopper rod 7 by the joining nut 61. The flange 84 is tightly secured to the upper end surface 10 of the stopper rod by the fastening nut 12 so as to be hermetically sealed. In addition, the pin 9 is inserted into the pin hole 74 in the stopper rod, thus the flange 84 and the stopper rod 7 are fixed so as to prevent from being rotated. The pin hole 74 may be provided in the upper end surface beforehand, or bored after the spindle and the stopper rod are assembled.

As occasion demands, hermetical sealing can be improved by, for example applying mortar, water glass or the like to the flange 84 and the upper end surface or joined surface 10 of the stopper rod, or sandwiching a graphite sheet as sealant therebetween. In the foregoing conventional example, hermetical sealing was maintained in the junction between the enlarged portion of the spindle and the concave portion in the upper end surface of the stopper rod. Contrary to the above, in the casting stopper of the invention, since hermetical sealing is maintained by the full surface of the flange, the incursion of atmospheric gas can be further completely prevented. If hermetical sealing is not maintained in this portion, because of a high flow velocity of the molten steel in the nozzle, a negative pressure is generated inside the stopper rod to cause the incursion of atmospheric air into argon gas, and thus, the molten steel is oxidized. Consequently, the problem of nozzle closing occurs, thus, necessitating the interruption of the casting.

To control a casting speed by the stopper rod 7, the upper portion of the spindle 8 is connected to a lever 30, which is provided to move the spindle up and down. Usually, washers 17 and 18 provided on the spindle, pinch the lever from the upper side and the lower side, and nuts 14, 16 are further provided next to the respective washers 17, 18 on the spindle, thus the spindle is fastened to the lever by nuts 14 and 16. Gas is supplied through the gas introduction route 40.

Now, the structural fine ceramics will be described in more detail. The structural fine ceramics is a refractory produced from a highly refined natural inorganic material or an artificially synthesized inorganic compound, and has an excellent mechanical property. A sintering method is normally used for molding the structural fine ceramics, and there are various sintering methods (including reaction sintering, post-reaction sintering, constant-pressure sintering, atmosphere pressure sintering, hot pressing, HIP, and very high pressure sintering).

Considering a characteristic of an aggregate of the fine ceramics, production costs and strength, the alumina is produced by constant-pressure sintering. The mullite is produced by reaction sintering or constant-pressure sintering. The silicon carbide is produced by reaction sintering or constant-pressure sintering. The silicon nitride is produced by reaction sintering, atmosphere pressure sintering, hot pressing or the like. The sialon is produced by reaction sintering.

EXAMPLE

The stopper for continuous casting used in the tundish according to the invention will be described in detail by the example with reference to FIG. 4. As shown in FIG. 4, the stopper rod had a total length: about 1.8 m, a diameter of the upper end surface: about 16 cm, and a diameter of the gas injection port in the tip portion: about 5 mm. While argon gas of about 10 L/min. is supplied to the stopper, aluminum killed steel of 450 ton (150 ton per charge) is cast. The casting was carried out smoothly until its end. For comparison, the casting was carried out by the use of the conventional stopper. In the conventional stopper, when about 200 ton was cast, the incursion of atmospheric air caused the molten steel to be oxidized, resulting in partial nozzle closing. Thus, it was impossible to maintain a casting speed unless a gas pressure was boosted to increase a flow rate of introduced gas by 1.5 times.

The tundish stopper used in the example comprises alumina graphite containing 60 wt. % of alumina, 24 wt. % of graphite, 9.2 wt. % of $SiO_2$, and 4.7 wt. % of SiC. Alumina or mullite was used as the structural fine ceramics. The alumina was formed into a nut by constant-pressure sintering, while the mullite was formed into a nut by reaction sintering. The bending strengths of the alumina and the mullite exceeded 150 MPa at 1000° C., and 100 MPa at 500° C., respectively.

The stopper of the invention for continuous casting is advantageous in that since complete atmospheric gas sealing can be provided by the upper end surface of the stopper rod and the flange portion, casting can be carried out with a specified gas flow rate even if a casting time is long. The stopper for continuous casting is also advantageous in that since the stopper rod and the spindle are joined together by the nut made of structural fine ceramics, no play occurs in the junction between the stopper rod and the spindle, and thus more complete atmospheric gas sealing can be provided.

What is claimed is:

1. A stopper for continuous casting comprising:

a stopper rod including a gas supply route provided in a center portion thereof, and an injection port provided in a tip portion thereof for discharging to an outside a gas passed through the gas supply route; and a spindle for actuating the stopper rod, wherein said stopper rod includes a joining nut, which is made of structural fine ceramics having a bending strength of at least 100 Mpa at a room temperature, integrally formed in a position located at a specified distance from an upper end of the stopper rod and in coaxial relation to an axis of the gas supply route, an upper end surface of the stopper rod being formed so as to be smooth and a pin hole being provided in the upper end surface so as to prevent from rotating;

said spindle includes a gas introduction route provided in a center portion thereof, a male screw provided in a tip portion thereof for being engaged with the joining nut, a male screw provided in an upper portion thereof for being engaged with a fasted nut for fixing the spindle to the stopper rod, and a flange, which is formed integrally with said spindle, tightly adhered to the upper end surface of the stopper rod and provided with a hole, into which a pin for preventing rotation is inserted; and said spindle is fixed to the stopper rod by the joining nut, said flange is fixed to the upper end surface of the stopper rod by the fastening nut so as to be hermetically sealed, and said flange and said stopper rod are prevented from being rotated by the pin inserted onto the pin hole.

2. A stopper for continuous casting according to claim 1 wherein said flange of the spindle is formed by being welded to the spindle.

3. A stopper for continuous casting according to claim 1 wherein said flange of the spindle and said upper end surface of the stopper rod are fixed to each other in a hermetically sealed manner by applying mortar, alternatively holding sealant therebetween.

4. A stopper for continuous casting according to claim 1, wherein said structural fine ceramics comprises any one selected from alumina, mullite, silicon carbide, silicon nitride, sialon and zirconia, or a composite material thereof.

* * * * *